US007036552B2

(12) United States Patent
Bovens

(10) Patent No.: US 7,036,552 B2
(45) Date of Patent: May 2, 2006

(54) METHOD AND DEVICE FOR HARDENING FOUNDRY CORES

(75) Inventor: Wilhelm Bovens, Kreuzlingen (CH)

(73) Assignee: Luber GmbH, Bazenheid (CH)

( * ) Notice: Subject to any disclaimer, the term of this patent is extended or adjusted under 35 U.S.C. 154(b) by 0 days.

(21) Appl. No.: 10/498,676

(22) PCT Filed: Jun. 11, 2003

(86) PCT No.: PCT/CH03/00368

§ 371 (c)(1),
(2), (4) Date: Jun. 10, 2004

(87) PCT Pub. No.: WO03/106072

PCT Pub. Date: Dec. 24, 2003

(65) Prior Publication Data

US 2005/0077023 A1 Apr. 14, 2005

(30) Foreign Application Priority Data

Jun. 17, 2002 (CH) ..... 1034/02

(51) Int. Cl.
*B22C 9/12* (2006.01)

(52) U.S. Cl. ..... 164/200; 164/16

(58) Field of Classification Search ..... 164/16, 164/200–202

See application file for complete search history.

(56) References Cited

U.S. PATENT DOCUMENTS 4,132,260 A * 1/1979 Luber ..... 164/16
4,362,204 A * 12/1982 Moore et al. ..... 164/16
4,467,855 A * 8/1984 Uzaki et al. ..... 164/7.1
4,483,384 A * 11/1984 Michel ..... 164/155.3
5,971,056 A * 10/1999 Bovens ..... 164/16

* cited by examiner

*Primary Examiner*—Kunag Y. Lin
(74) *Attorney, Agent, or Firm*—Herbert Dubno

(57) ABSTRACT

The invention relates to a method for hardening foundry cores from sand-containing molding materials. The core, for the purpose of hardening it, is subjected to a catalyst vapor/gas mixture in a core molding tool (20). and then to a pressurized air flow, at a predetermined pressure and predetermined temperature, via a gassing plate (30) that can be coupled to the core molding tool in a gas-tight manner. The amine is, preferably during core injection, supplied to a heating and mixing stage (17) in liquid form and in a dosed manner and converted to its gaseous state. Once the gassing plate has been coupled to the core molding tool in a gas-tight manner, heated pressurized air is guided through the heating and mixing stage (17) charged with the amine gas within a predetermined time interval and with proportional pressure increase for gassing the tool in a time-controlled manner. From there, the gas is guided as a catalyst vapor/gas mixture through the sand-containing molding material in the core molding tool. Heated pressurized air is guided through the gassed sand-containing molding material in the core-molding tool within a predetermined time interval to rinse the tool in a time-controlled manner.

3 Claims, 1 Drawing Sheet

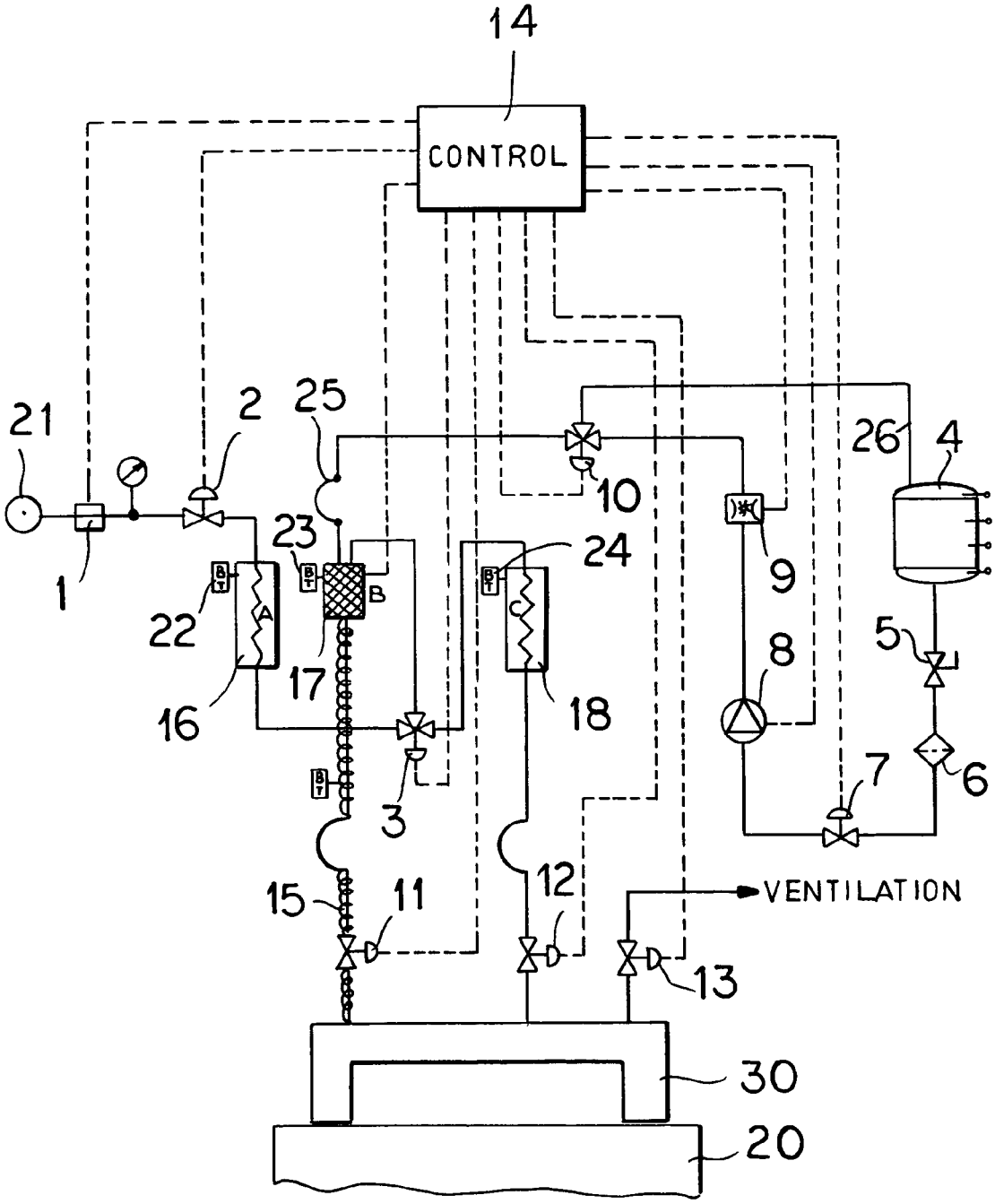
14
CONTROL
21
2
25
26
4
10
1
23
24
9
22
A
B
C
5
8
17
16
18
6
7
3
15
11
12
VENTILATION
13
30
20

METHOD AND DEVICE FOR HARDENING FOUNDRY CORES

CROSS REFERENCE TO RELATED APPLICATIONS

This application is a national stage of PCT/CH03/00368 filed Jun. 11, 2003 and based upon Swiss national application 1034/02 of Jun. 17, 2002 under the International Convention.

FIELD OF THE INVENTION

The present invention relates to a method of hardening foundry cores of sand-containing moldable compositions in which the cores, for hardening in a core-shaping tool (mold), is subjected to treatment with a catalyst-vapor/ carrier-gas mixture and subsequently with a compressed air stream, each at predetermined pressure and predetermined temperature, through a gas-treatment plate which can be coupled hermetically or in a gas-tight-manner with the core-shaping tool.

BACKGROUND OF THE INVENTION

Cold hardening methods that are known include for example the so-called cold box method, in which two components of a synthetic resin system are introduced to the core sand and the sand is hardened as soon as an amine, for example an alkyl amine or a methyl formiate, is added as a catalyst.

One of these components can be for example a polyester resin, a polyether resin or an optional synthetic resin of liquid consistency with reactive hydroxyl groups. The second component is in all cases an organic isocyanate. The two components are basically mixed with the mold sand and then shaped. To catalyze the reaction and the handling and to permit satisfactory use of the amine, various investigations have been undertaken heretofore.

The known methods have, however, a common drawback in that the hardening process requires significant time. For example, the shaping of the core-sand mixture in the shaping tool or mold of a core-shaping machine, often requires only a fraction of a second, contrasting with the subsequent gas treatment for hardening the core which requires several seconds, thereby making the gas treatment a high cost factor.

To reduce the gas-treatment time or the hardening time, attempts have been made to add the amine in excess with the danger that a resolubilization of the binder can occur which can reduce the possible end strength of the core to about 80 to 85%.

In a further process (EP 0229959) metering pumps between the catalyst source and the mixing location for the carrier gas and catalyst are turned on in order to have better metering of the catalyst which also gives rise to an unsatisfactory result since the pressure conditions in the catalyst feed are initially absolutely indifferent with respective metering processes.

It has also been proposed (CH Patent 603276), to store both catalyst vapor/carrier gas mixture and also the compressed air each in a metering vessel and to fire them one after the other impulsively into the core whereby the compressed air with a greater volume is stored and heated to a higher temperature than the catalyst vapor/carrier gas mixture. For this feature, however, the technical cost is enormous and apparatus of this kind has little variability.

In addition, the European patent EP 0881 014 describes a method of the aforedescribed type in which the valve means encompasses a multipath valve in the supply line of the storage vessel which can be temporarily switched to a recycling line running to the supply vessel for pressure equalization in the feed system.

This feature enables the pressure conditions in the catalyst feed for each dosing operation to be maintained constant following the respective preceding pressure equalization.

Present-day techniques can utilize program-controlled switching.

OBJECT OF THE INVENTION

The object of the present invention is thus to provide a method for the hardening of foundry cores of sand-containing moldable compositions which ensures significantly shorter gas treatment and flushing times with a minimum use of the requisite amines.

It is also an object to provide an apparatus for producing a core.

SUMMARY OF THE INVENTION

This is achieved in accordance with the invention in that preferably during the core shoot, the amine is metered in liquid form into a heating and mixing stage and is there converted into its gaseous state;

in that, after hermetic coupling of the gas-inlet or gas-supply plate to the core mold, the sand-containing composition is treated therein with a catalyst-vapor/carrier-gas mixture conducted through the mold and formed by passing heated compressed air therethrough within a predetermined duration and with a proportional pressure increase through the heating and mixing stage to charge the compressed air with the amine in its gaseous state for a controlled-duration gas treatment; and in that for flushing for a controlled duration, heated compressed air is conducted for a predetermined time from a separate feed means through the gas-treated sand-containing mold composition in the core-shaping tool.

A preferred feature of the method of the invention resides in that the compressed air for the gasification is variably heated for gas treatment with increased heating of the catalyst-vapor/carrier-gas mixture so as to achieve a so-called contour hardening.

In addition, it is advantageous for the compressed air serving as the flushing air to be additionally heated when before the supply of the amine in liquid form to the heater and mixing state, a pressure equalization at the feed side is to be produced and when the catalyst-vapor/carrier-gas mixture along its path to the core-shaping tool is to be accompanied by heating.

In addition the present invention comprises a device for carrying out the method of hardening foundry cores of sand-containing moldable compositions in which the device includes a gas-treatment plate which can be coupled in a gas-tight manner to the core-shaping tool for the hardening of the core in the core-shaping tool, or the like, to enable a catalyst-vapor/carrier-gas mixture and subsequently a compressed air stream, each with predetermined pressure and predetermined temperature, to be used.

According to the invention this device is characterized in that the amine in liquid form is fed from a supply vessel by means of a flow metering or dosing into a heating and mixing stage and is there transformed into its gaseous state, which heating and mixing state is connected with the compressed air source via a proportional pressure regulator and a preheater or switchover valve means to enable controlled duration gas treatment with heated compressed air by passing the heated compressed air over a predetermined duration through the heating and mixing stage to produce an amine-charged gas. The heating and mixing stage is connected through a valve-closeable passage with the core-shaping tool or the gas-inlet or gas-supply plate so that the catalyst-vapor/carrier-gas mixture is passed through the sand-containing moldable composition in the core-shaping tool and whereby for the controlled duration flushing with the heated compressed air, the compressed air source is connected in a flow path with the core-shaping tool or the gas-inlet or gas-supply plate through the switchover valve means and optionally an after-heater and a blocking valve.

Accordingly in an advantageous refinement of the invention for a variable heatability of the compressed air, the preheater can have a temperature control associated therewith and prior to the supply of the amine in liquid form to the heater and mixing stage, the feed line of the liquid amine vessel, with the aid of the flow meter via a switchover valve is temporarily switched to a recycle line to the supply vessel for a pressure equalization in the amine feed system.

BRIEF DESCRIPTION OF THE DRAWING

An exemplary embodiment of the subject matter of the invention is described in the following with reference to the sale FIGURE of the drawing which illustrates in a block diagram form the apparatus according to the invention for hardening of foundry cores and which is described in greater detail.

SPECIFIC DESCRIPTION

The illustrated device for the hardening of foundry cores made or a sand-containing moldable composition and which is connected to a core-shaping tool or the mold 20 of a core-shooting machine which has otherwise not been illustrated, as shown, encompasses a gas-treatment plate or hood 30 which can be coupled in a gas-tight manner with the core-shaping tool 20 and which has upstream thereof a heating and mixing stage 17 for converting the liquid amine into its gaseous state and for generating a catalyst-vapor/carrier-gas mixture serving for gas treatment of the core as will be described in greater detail in the following.

According to the invention, the amine flows in a liquid form from a supply vessel 4 and is metered or dosed by means of the flow meter 9 or the like into the heating and mixing stage 17 where it is transformed into its gaseous state. The heating and mixing stage 17 is connected in a flow path with a compressed air source 21 over a proportional pressure controller 1 and a preheater 16 together with a switchover valve means 3. For a controlled duration gas treatment, heated compressed air within a predetermined duration is passed through the heating and mixing stage 17. The stage 17 is closable by a valve 11 and is connected by the preferably heatable duct 15 with the core-shaping tool 20 or the gas-inlet or gas-supply plate 30. The catalyst-vapor/carrier-gas mixture is conducted through the sand-containing moldable composition in the core shaping tool 20. For a controlled duration flushing with the heated compressed air, the compressed air source 21 is in a flow connection through the switchover valve means 3 and optionally an after-heater 18 and a blocking valve with the core-shaping tool 20 or the gas inlet plate 30.

For this purpose and a variable heatability of the compressed air, the preheater 16 has a temperature controller 22 associated therewith. Similarly the heating and mixing stage has a temperature controller 23 associated therewith and the after-heater 18 has a temperature controller 24 associated therewith.

Prior to the feed of the amine in liquid form into the heating and mixing stage 17, the feed line 25, via the blocking valve 5, the filter 6, the control valve 7, a pump 8 and the flow meter 9, temporarily forms a recycle from the liquid amine vessel 4 via the switchover valve 10 through the recycle line 26 back to the supply vessel 4 for pressure equalization in the first run system.

In addition, the gas supply plate 30 can be provided with a venting valve 13.

Present day technology enables the switchover and control through a control circuit 14 in a programmable manner.

Thus it is possible with this arrangement to feed the amine in liquid form in a dosed or metered manner to a heating and mixing stage and there to transform it into its gaseous state. Then, after hermetic coupling of the gas supply plate to the mold, for a timed gas treatment, heated compressed air within a predetermined duration and with proportional pressure increase is passed through the heating and mixing stage charged with the amine gas and from there as a catalyst-vapor/carrier-gas mixture, is passed through the sand-containing mold composition in the core-shaping tool. Then, for a timed flushing, heated compressed air within a predetermined time is passed through the gas-treated sand-containing mold composition in the core-shaping tool. In addition, it is possible with this system to variably heat the compressed air for a gas treatment with increasing heating of the catalyst-vapor/carrier-gas mixture in order to achieve a so-called contour hardening. Furthermore, the compressed air serving as the flushing air can be additionally heated and before the supply of amine in liquid form into the heating and mixing stage can be provided in a first-run pressure equalization while the catalyst-vapor/carrier-gas mixture on its way to the core-shaping tool can be accompanied by heating.

With these features of the invention a substantially shortened gas treatment and flushing time with a minimum of the requisite amine can be ensured.

The invention claimed is:

1. A device for hardening a foundry core in a core-shaping tool, comprising:

a gas-supply plate hermetically couplable to said tool;

a heating and mixing stage connected to said gas-supply plate and adapted to mix gas components to form a gas mixture and heat the gas mixture prior to feeding the gas mixture to said gas-supply plate;

a compressed air source provided with a proportional pressure controller connected to said heating and mixing stage to deliver compressed air thereto with a pressure increase over time;

a heater connected with said gas-supply plate for delivering heated compressed air to said gas-supply plate;

respective cut-off valves between said heating and mixing stage and said gas-supply plate and between said heater and said gas-supply plate;

a switchover valve between said proportional controller and said heating and mixing stage and between said proportional controller and said heater for selectively supplying the compressed air to said heating and mixing stage and to said heater; and a supply vessel for an amine catalyst capable of hardening said core connected through a dosing unit with said heating and mixing stage whereby upon operation of said switchover valve a mixture of said amine and compressed air in heated form is passed through said gas-supply plate into said tool for a predetermined duration with progressive pressure increase and then, upon further operation of said switchover valve, heated compressed air is passed through said gas-supply plate to flush through said tool.

2. The device defined in claim 1, further comprising a preheater between said proportional pressure controller and said switchover valve, and a temperature controller for said preheater for varying heating of compressed air passed therethrough.

3. The device defined in claim 2, further comprising another valve between said dosing unit and said heating and mixing stage and connected with said supply vessel for recycling said amine to said supply vessel prior to passing the amine to said heating and mixing stage.

* * * * *